US008628001B2

(12) United States Patent
Hallam

(10) Patent No.: US 8,628,001 B2
(45) Date of Patent: Jan. 14, 2014

(54) BOXES

(75) Inventor: Chris Hallam, Bradford (GB)

(73) Assignee: Concept Packaging Services Limited (GB)

( * ) Notice: Subject to any disclaimer, the term of this patent is extended or adjusted under 35 U.S.C. 154(b) by 561 days.

(21) Appl. No.: 12/920,930

(22) PCT Filed: Mar. 4, 2009

(86) PCT No.: PCT/GB2009/050220

§ 371 (c)(1),
(2), (4) Date: Nov. 29, 2010

(87) PCT Pub. No.: WO2009/109783

PCT Pub. Date: Sep. 11, 2009

(65) Prior Publication Data

US 2011/0155797 A1 Jun. 30, 2011

(30) Foreign Application Priority Data

Mar. 4, 2008 (GB) ..... 0804023.0

(51) Int. Cl.
*B65D 5/42* (2006.01)

(52) U.S. Cl.
USPC ..... 229/122.34; 229/122.32; 229/178; 229/195

(58) Field of Classification Search
USPC ..... 229/117.01, 117.07, 117.08, 122.32, 229/122.34, 163, 171, 173, 178, 195, 197, 229/199
See application file for complete search history.

(56) References Cited

U.S. PATENT DOCUMENTS

| | | | | |
|---|---|---|---|---|
| 618,468 | A * | 1/1899 | Knobeloch | 229/122.34 |
| 2,002,493 | A * | 5/1935 | Einson | 229/117.05 |
| 2,118,011 | A * | 5/1938 | Zalkind | 229/199 |
| 2,829,815 | A * | 4/1958 | Copeman | 229/122.34 |
| 2,993,634 | A * | 7/1961 | Wilkins | 229/195 |
| 4,463,997 | A * | 8/1984 | Densen | 229/120.32 |
| 5,421,509 | A * | 6/1995 | Thuin et al. | 229/117.07 |
| 2004/0011860 | A1* | 1/2004 | Lebras | 229/167 |
| 2007/0221715 | A1* | 9/2007 | Tibbels et al. | 229/125.19 |
| 2008/0223911 | A1* | 9/2008 | Mazurek | 229/122.32 |

FOREIGN PATENT DOCUMENTS

| | | |
|---|---|---|
| FR | 923462 | 9/1995 |
| GB | 2154210 | 11/1984 |
| GB | WO2009/109783 | 9/2009 |
| US | WO0216213 A2 | 2/2002 |

OTHER PUBLICATIONS

International Search Report for PCT/GB2009/050220; Applicant: Concept Packaging Services Limited, Filing Date Apr. 3, 2009.

* cited by examiner

*Primary Examiner* — Gary Elkins
(74) *Attorney, Agent, or Firm* — Shumaker, Loop & Kendrick, LLP

(57) ABSTRACT

A partly constructed set up box in a generally flat configuration, the partly constructed set up box comprising an inner blank and an outer blank, wherein the inner blank and the outer blank are secured relative to each other by a securement means.

9 Claims, 14 Drawing Sheets

BOXES

FIELD OF THE INVENTION

The present invention relates to corner constructions for a box, to partly constructed set up boxes, to methods of construction of set up boxes and to set up box constructions. The present invention further relates to blanks for the aforesaid aspects.

BACKGROUND TO THE INVENTION

A box (which expression includes boxes with or without lids) can be constructed from an inner layer and an outer layer, in which case it is referred to as a "set up box", also referred to as a "rigid box". The inner layer of a set up box is often formed of a board material, which is covered by a paper material. These boxes are supplied to a customer in made up or set up form. It would be desirable for packing efficiency for the set up boxes to be transported from an original manufacturer in a substantially flat configuration, to be assembled only when needed. The inner and outer layers when they are ready for manufacture need to be mutually aligned. Even if they were to be mutually aligned during the manufacturing process prior to packing, transportation of the inner and outer layers would lead to misalignment which can not be coped with by automated assembly procedures.

Furthermore, there is often an area of weakness in the construction of set up boxes in the corner area meaning that their applications can be restricted.

It is an aim of preferred embodiments of the present invention to obviate or overcome disadvantages accounted in the prior art, whether such prior art disadvantages are referred herein or otherwise.

SUMMARY OF THE INVENTION

According to the present invention in a second aspect, there is provided a partly constructed set up box in a generally flat configuration, the partly constructed set up box comprising an inner blank and an outer blank, wherein the inner blank and the outer blank are secured relative to each other by a securement means.

Suitably, the securement means comprises an adhesive tape.

Suitably, the securement means comprises a tongue and slot arrangement.

Suitably, the tongue is on the outer blank and the slot is in the inner blank.

A box can, therefore, be constructed without the need for an adhesive if desired.

Suitably, the outer blank comprises a first side wall panel connected to a second side wall panel from which second side wall panel the securement means secures the outer blank to the inner blank.

Suitably, the outer blank comprises two side wall constructions including a tongue on each to engage in a corresponding slot in the inner blank.

Suitably, the inner blank comprises a base panel in which the slot is located.

Alternatively, the inner blank comprises a side wall in which the slot is located.

Suitably, the inner blank comprises a side wall panel configured to be sandwiched between the first side wall panel of the outer blank and the second side wall panel of the outer blank.

Suitably, the outer blank comprises a first side wall construction and the securement means is configured whereby the first side wall construction can be assembled. Suitably, there is a second side wall construction opposite the first side wall construction, which further side wall construction can be assembled. Suitably, there is a further side wall construction adjacent the first side wall construction, which further side wall construction can be assembled. Suitably, there is an additional side wall construction opposite the further side wall construction, which additional side wall construction can be assembled. The side wall construction assembly is normally moving the side wall construction from a flat or set up configuration to an upstanding or made up configuration. Thus the side wall constructions can be assembled with the securement means in place.

Thus it is advantageous that the securement means still allows for relative movement of the inner layer and the outer layer to permit the assembly of the side wall constructions to an upstanding configuration. In preferred embodiments of the present invention, the relative movement is relative sliding movement of the inner layer and outer layer. The tongue slidingly fits into the slot.

Suitably, the outer blank comprises a cover card panel. Suitably, the cover card panel extends from a side wall of the outer blank.

According to the present invention in a second aspect, there is provided a method of manufacture of a set up box, the method comprising the steps of, in a first location, providing a partly constructed set up box in a generally flat configuration, the partly constructed set up box comprising an inner blank and an outer blank, wherein the inner blank and the outer blank are secured relative to each other by a securement means.

Suitably, the method further comprises transporting the partly constructed set up box to a second location and constructing the set up box.

Suitably, the transporting step comprises stacking a plurality of partly constructed set up boxes on top of each other.

Suitably, the transportation step comprises a form of motorised transportation.

Suitably, the transportation step comprises the step of packaging a plurality of said partly constructed set up boxes together. Suitably, the partly constructed set up boxes are packaged on a pallet.

Suitably, the first location is in a building separate from the second location.

Suitably, the constructing step comprises moving at least one side wall construction of the set up box to an upstanding configuration. Suitably, the box comprises a plurality of side wall constructions each of which is moved to an upstanding configuration.

According to the present invention in a third aspect, there is provided a corner construction for a box, the corner construction comprising a first side wall adjacent to a second side wall, the first side wall comprising a cut out portion, the second side wall comprising an extension piece for fitting in the cut out portion of the first side wall.

Thus the adjacent side walls can interlock to form a stronger corner construction.

Suitably, the corner construction comprises a notch on one of the extension piece or the cut out portion in addition to the cut out portion and a protrusion on the other of the protrusion and the cut out portion for fitting into the notch.

Suitably, the cut out portion is at the corner of the construction.

Suitably, the cut out potion extends no more than 25% of the length of the wall into which it is cut out.

Suitably, the extension piece corresponds in shape to the cut out portion. This way they can fit together tightly so as to secure the side wall in place.

Suitably, the cut-out portion is triangular in shape.

Suitably, there is additionally provided a base panel. Suitably, the first side wall is connected to the base panel. Suitably, the second side wall is connected to the base panel.

Suitably, the box is a set up box. Suitably, the corner construction is an inner layer of the set up box. Suitably, there is additionally provided an outer layer comprising a base panel and a first side wall construction sandwiching the corner construction therebetween.

The second aspect of the present invention can, optionally, be combined with the first aspect of the present invention.

According to the present invention in a third aspect, there is provided a set up box comprising an inner layer and an outer layer, the inner layer comprising a base panel and an upstanding side wall, the outer panel comprising a base panel, a first side wall construction and a further side wall construction, the first side wall construction comprising a first side wall panel connected to the base panel and a second side wall panel connected to the first side wall panel of the outer layer, wherein the first side wall construction sandwiches the upstanding side wall of the inner layer therebetween, the further side wall construction adjacent the first side wall construction, the further side wall construction comprising a first side wall panel connected to the base panel; the set up box further comprising a webbing extending between the first side wall construction and the further side wall construction to provide a tab configured to fold over the upstanding wall of the inner layer.

Suitably, the webbing comprises a first panel hingedly connected to the first panel of the first side wall construction and a second panel hingedly connected to the first panel of the further side wall construction and wherein the first panel is hingedly connected to the second panel. Suitably, the tab extends from the first panel.

Suitably, the webbing is sandwiched between the first panel of the first side wall construction and the upstanding panel of the inner layer.

The third aspect of the invention can, optionally, be combined with the first aspect of the invention and/or the second aspect of the invention.

BRIEF DESCRIPTION OF THE DRAWINGS

The present invention will now be described, by way of example only, with reference to the drawings that follow; in which.

DESCRIPTION OF THE PREFERRED EMBODIMENTS

Figure 1:
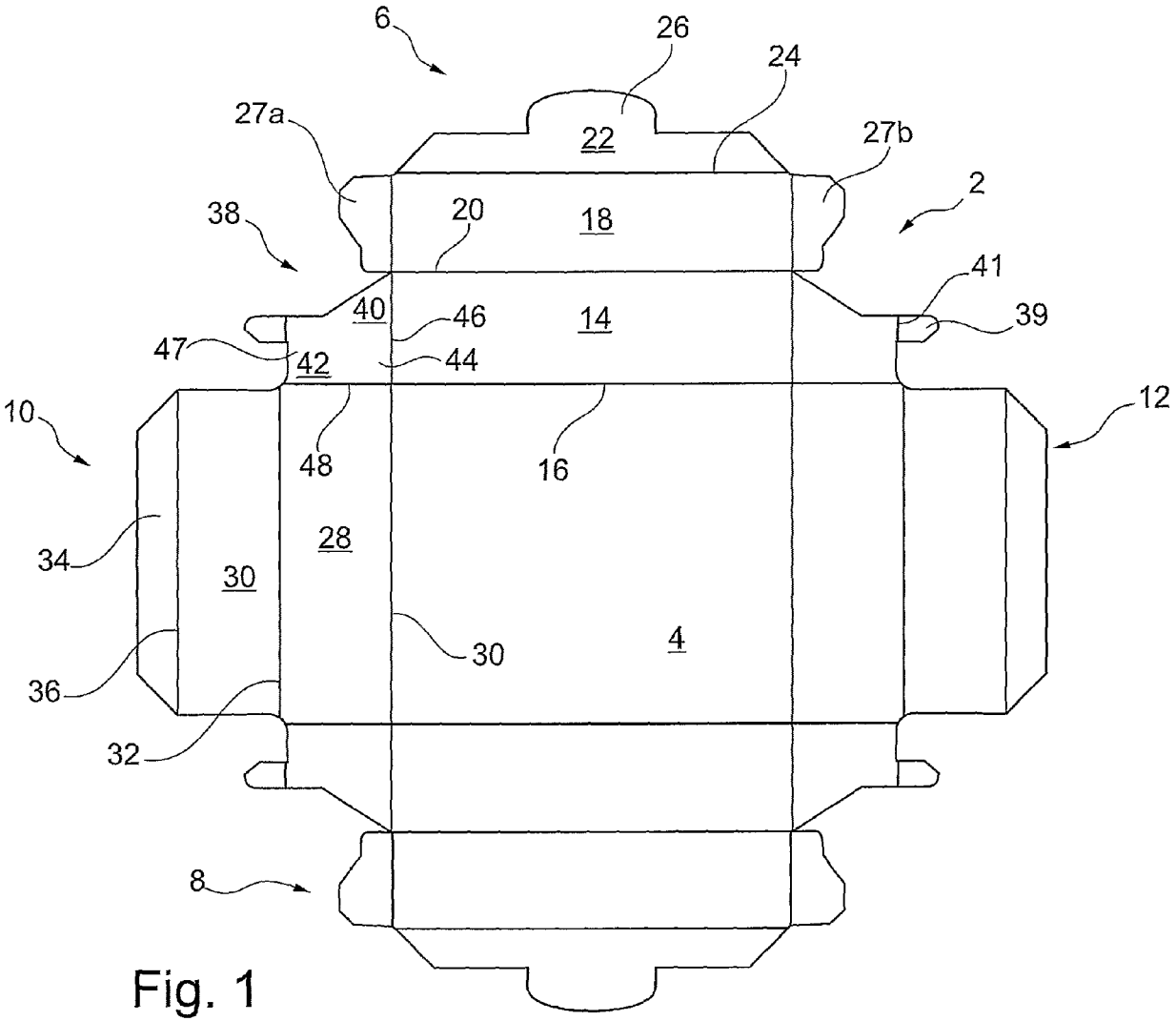
FIG. 1 is a plan view of an outer panel blank for use with an embodiment of the present invention.

With reference to FIG. 1 of the accompanying drawings, there is shown a blank 2 for an outer layer for a set-up box. The blank 2 is made from 350 micron carton board. Internal solid lines are fold lines produced by scored creases or partial cuts. The dashed lines are fold lines produced by perforated scores.

The blank 2 comprises a rectangular base panel 4, a first side wall construction 6 extending from one major edge of the base panel 4, a second side wall construction 8 extending from the opposite major edge of the base panel 4, a third side wall construction 10 extending from a minor edge of the base panel 4 and a fourth side wall construction 12 extending from the opposite minor edge of the base panel 4. The first and second side wall constructions 6, 8, respectively are similar and so only one will be described in detail. The third and fourth side wall constructions 10, 12, respectively are similar and so only one will be described in detail.

First side wall construction 6 comprises a first side wall panel 14 hinged to base panel 4 by crease 16, a second side wall panel 18 hinged to first side wall panel 14 by a wide crease 20 and a tongue panel 22 hinged to second side wall panel 18 by a cut crease 24. Tongue panel 22 includes a projecting tongue 26 at the end thereof. At either end of second side wall panel 18 are flaps 27*a*, 27*b*.

Third side wall construction 10 comprises a first side wall panel 28 hinged to base panel 4 by a crease 30, a second side wall panel 32 hinged to first side wall panel 28 by a wide crease 32 and a marginal flange 34 hinged to second side wall panel 30 by a cut crease 36.

The first side wall panel 14 of the first side wall construction 6 is connected to the first side wall panel 28 of the third side wall construction 10 by a webbing 38. The webbing 38 comprises a first panel 40 hinged to a second panel 42 by a perforated crease 44. First panel 40 of the webbing 38 is hinged to the first side wall panel 14 of first side wall construction 6 by crease 46. Second panel 42 of the webbing 38 is hinged to the first side wall panel 28 of third side wall construction 10 by crease 46.

Extending from each web 38 is a shoulder tab 39 hinged to the first panel 40 of the web 38 by a crease 41.

Figure 2:
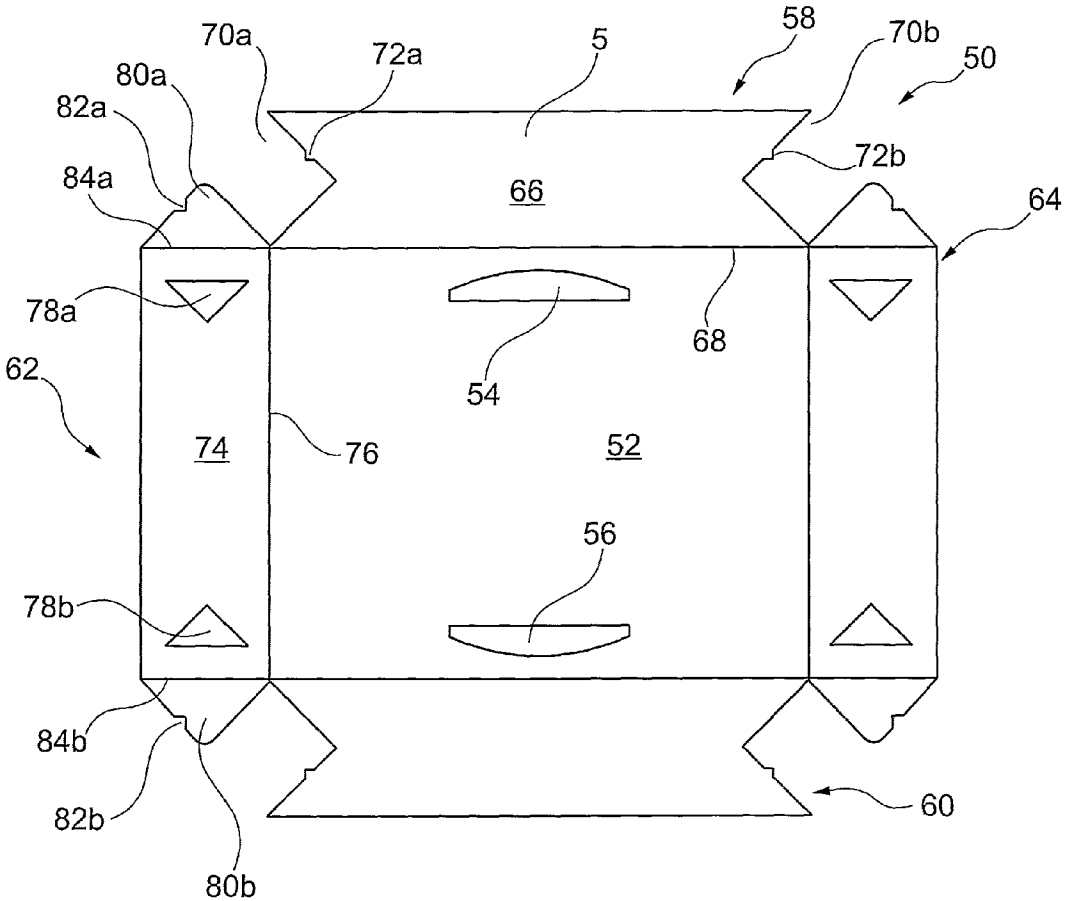
FIG. 2 is a plan view of an inner panel blank for use with the outer blank shown in FIG. 1.

Referring to FIG. 2 of the accompanying drawings, there is shown a blank 50 for an inner layer for a box. The blank 50 is made from 1200-1500 micron carton board, which makes it relatively more rigid than the blank 2 for the outer panel. Internal solid lines are fold lines produced by scored creases or partial cuts.

Inner panel blank 50 comprises a rectangular base panel 52 including first and second cut-out portions 54, 56, respectively. Base panel 52 is similar in size and shape to base panel 4.

Inner blank panel 50 additionally comprises a first side wall construction 58 extending from one major edge of the base panel 52, a second side wall construction 60 extending from the opposite major edge of base panel 52, a third side wall construction 62 extending from a minor edge of base panel 52 and a fourth side wall construction 64 extending from the opposite minor edge of base panel 52. The first and second side wall constructions 58, 60, respectively are similar and so only one will be described in detail. The third and fourth side wall constructions 62, 64, respectively are similar and so only one will be described in detail.

First side wall construction 58 comprises a side wall panel 66 hinged to base panel 52 by score 68. At either end of side wall panel 66 are generally V-shaped cut-out portions 70*a*, 70*b* each of which include a generally V-shaped protruding notch 72*a*, 72*b*.

Third side wall panel 62 comprises a first side wall panel 74 hinged to base panel 52 by score 76. The first side wall panel 74 includes two triangular cut-out portions 78*a*, 78*b* and at either end of the first side wall panel 74 a triangular extension pieces 80*a*, 80*b* each of which include a generally V-shaped cut-out portion 82*a*, 82*b*. The triangular extension pieces 80*a*, 80*b* are hinged to first side wall panel 74 by scores 84*a*, 84*b*, respectively.

The triangular shaped extension piece 80*a* corresponds in size and shape to the V-shaped cut-out portion 70*a* while the protruding notch 72*a* corresponds in size and shape to the V-shaped cut-out portion 82*a*. The same applies to the other corresponding flaps, protruding notches and cut-out portions.

Figure 3:
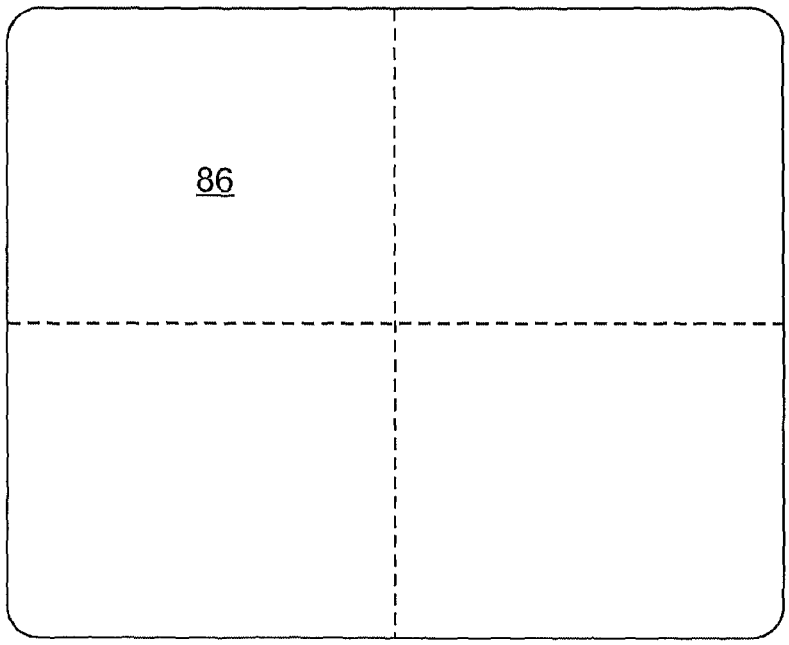
FIG. 3 is a plan view of a liner panel for use with the blank shown in FIG. 2.

Referring to FIG. 3 of the accompanying drawings there is shown a rectangular final cover card 86 made from 300 micron carton board and corresponding in shape to the base panel 52 of the inner blank 50.

Figure 4:
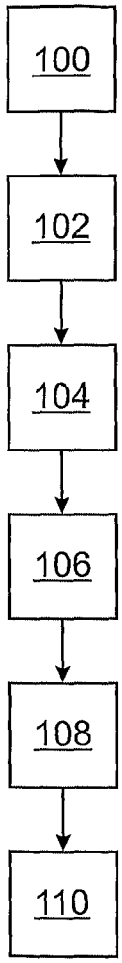
FIG. 4 is a flow diagram for use in describing a method of manufacture of a box from the blank components of FIGS. 1-3.

There will now be described, with reference to FIG. 4 of the accompanying drawings, a method of manufacture of a box from the blank components illustrated in FIGS. 1-3.

In step 100 the rectangular cover card 86 is attached to the reverse of base panel 52, typically this will be by a glue line near each of the shorter edges of the cover card 86.

In step 102 the inner blank 50 is aligned relative to the outer blank 2 so that the base panels 4, 52, respectively, are aligned. The rectangular cover card 86 is, therefore, sandwiched between the outer blank 2 and the inner blank 50.

In step 104 tongue 26 is inserted into cut out slot 54 and the other tongue on the outer blank 2 is inserted into cut out 56. The tongues 26 are dimensioned to fit into the cut outs 54, 56 with limited freedom of movement, typically say 0.5 mm-1.0 mm. This is sufficient however to keep the blanks 2, 50 in mutual alignment. This means that during transportation of the combined blanks 2, 50, they stand a much greater chance of staying in sufficient mutual alignment so that an automated or manual assembly process can more easily cope with them in the form in which they arrive. The tongue 26 and cut out slot 54 cooperate to form a securement means to secure the outer blank 2 relative to the inner blank 50.

Although two tongues 26 and corresponding cut outs 54 are shown, and generally are preferred, one tongue 26 and cut out slot 54 can be used if desired.

Figure 5:
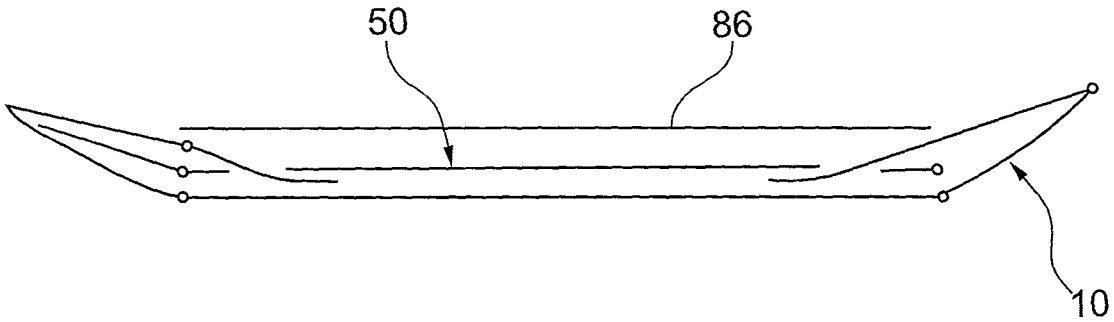
FIG. 5 is a schematic cross-sectional view of a partly assembled box according to the present invention.

Referring to FIG. 5 of the accompanying drawings, the blanks 2, 50 are shown in their partly assembled box state after this step. FIG. 5 is a schematic drawing with hinged connections between panels being shown by dots such as at 88. The cross-sectional representation in FIG. 5 is somewhat stylised for clarity. In particular, the gaps between layers are emphasised. The blanks are still essentially in a flat configuration; there are multiple layers but no significant upstanding walls and blanks in this configuration can be stacked conveniently without a likelihood of crushing damage from each other even in deep stacks.

In step 106, which in a normal supply chain process will normally take place after transport of the generally flat blanks shown in FIG. 5, the side wall constructions along the long edges of the box construction are raised to be at 90° to the base panels 4, 52. Normally this is done by applying force to first side wall panel 14 of the first side wall construction 6 and to opposite first side wall panel which will also raise the second side wall panel 18 of the first side wall construction 6 of the outer blank 2 and the side wall 66 of the first side wall construction 58 of the inner blank 50.

In this configuration, first side wall panel 66 of the inner blank 50 is sandwiched between first side wall panel and second side wall panel 18 of the outer blank 2. The wide crease 20 accommodates the width of the first side wall panel 66. Tongue panel 22 lies flat on base panel 52 of the inner blank 50, with the tongue 26 in cut out 54.

In step 108 the first side wall panel 74 of the inner blank 50 is raised to be at 90° to the base panels 4, 52. This involves inserting the flap 80*a* between the first side wall panel 14 and second side wall panel 18 of the outer blank 2 and in doing so the flap 80*a* is pushed into the correspondingly V-shaped cut out portion 70*a*. It will be appreciated that the protruding notch 72*a* will not slide into the cut out 82*a* smoothly; rather there is a positive engagement as the protruding notch 72*a* enters the cut out 82*a*. When the protruding notch 72*a* is then engaged in the cut out 82*a* it positively engages the flap 80*a* in the V-shaped cut out portion 70*a* and therefore helps in holding first side wall panel 74 in place. The same is done with the other side wall panel of the inner blank 50. The flaps 27*a*, 27*b* of the outer blank 2 now rest against the internal side of the side walls panels 74.

In step 110 the first side wall panel 28 of the third wall construction 10 of the outer blank 2 is raised towards the upstanding first side wall 74. The second side wall panel 30 is then folded over the first side wall 74, sandwiching the first side wall 74 between the first side wall panel 28 and the second side wall panel 30. In the process the webbing 38 folds inwardly and lies between the first side wall panel 28 of the outer blank 2 and the first side wall 74 of the inner blank 50. The shoulder tab 39 sandwiches the first side wall 74 between itself and the first side wall panel of the outer blank 2. This better ties the webbing 38 into the corner constructions and helps to maintain the integrity and strength of the corner construction. The marginal flange 34 now lies flat on the base panel 52 of the inner blank 50. It is noted that the tongue panel 22 and marginal flange 34 have mitred ends to cooperate together. The same process is carried out on the opposing wall.

Cover card 86 is present to ensure that the tongues 26 and cut outs 54, 56 are not visible from the exterior of the box through base panel 4. To reduce costs the cover card 86 can be excluded.

Thus, in steps 100, 102 and 104 in a first location, a partly constructed set up box in a generally flat configuration is provided, the partly constructed set up box comprising an inner blank and an outer blank, wherein the inner blank and the outer blank are secured relative to each other by a securement means; the partly constructed set up box is transported to a second location and constructed as a made up box.

It will be appreciated that the securement means, while securing the inner panel 50 relative to the outer panel 2, permits relative sliding movement sufficient to enable the side wall constructions to be assembled into their upstanding (made up) configurations.

Figure 6:
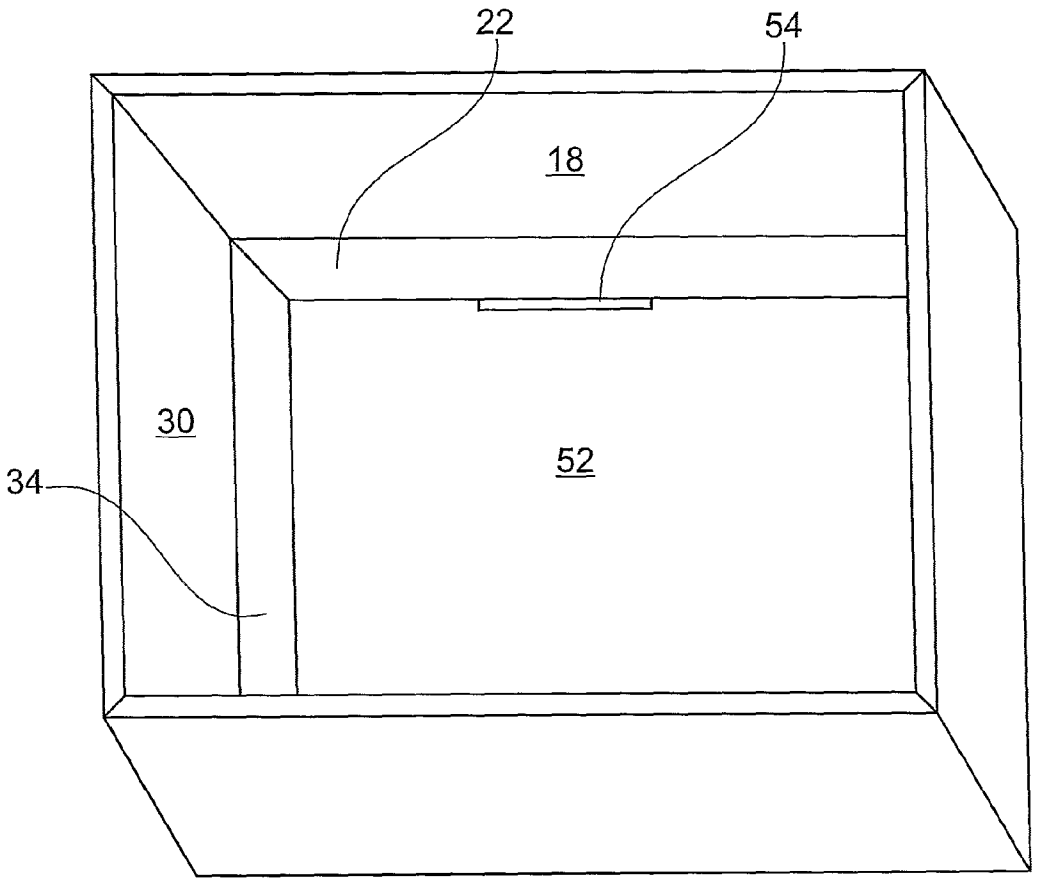
FIG. 6 is a schematic isometric view of a box constructed of the blanks of FIGS. 1-3.

If desired, a base insert can be placed into the now formed box, shown in the accompanying FIG. 6 to cover the base panel 52 of the inner blank 50. FIG. 6 shows the box without such an insert.

A large number of variations of the described embodiment of the present invention is possible within the scope of the appended claims. Examples of possible variations include, but are not limited to, the following:

Firstly, the set up box can be modified to be a padded box by the inclusion of a padded layer made, for instance, from a foam material between the base panel 52 of the inner blank 50 and the base panel 4 of the outer blank 2.

Figure 7:
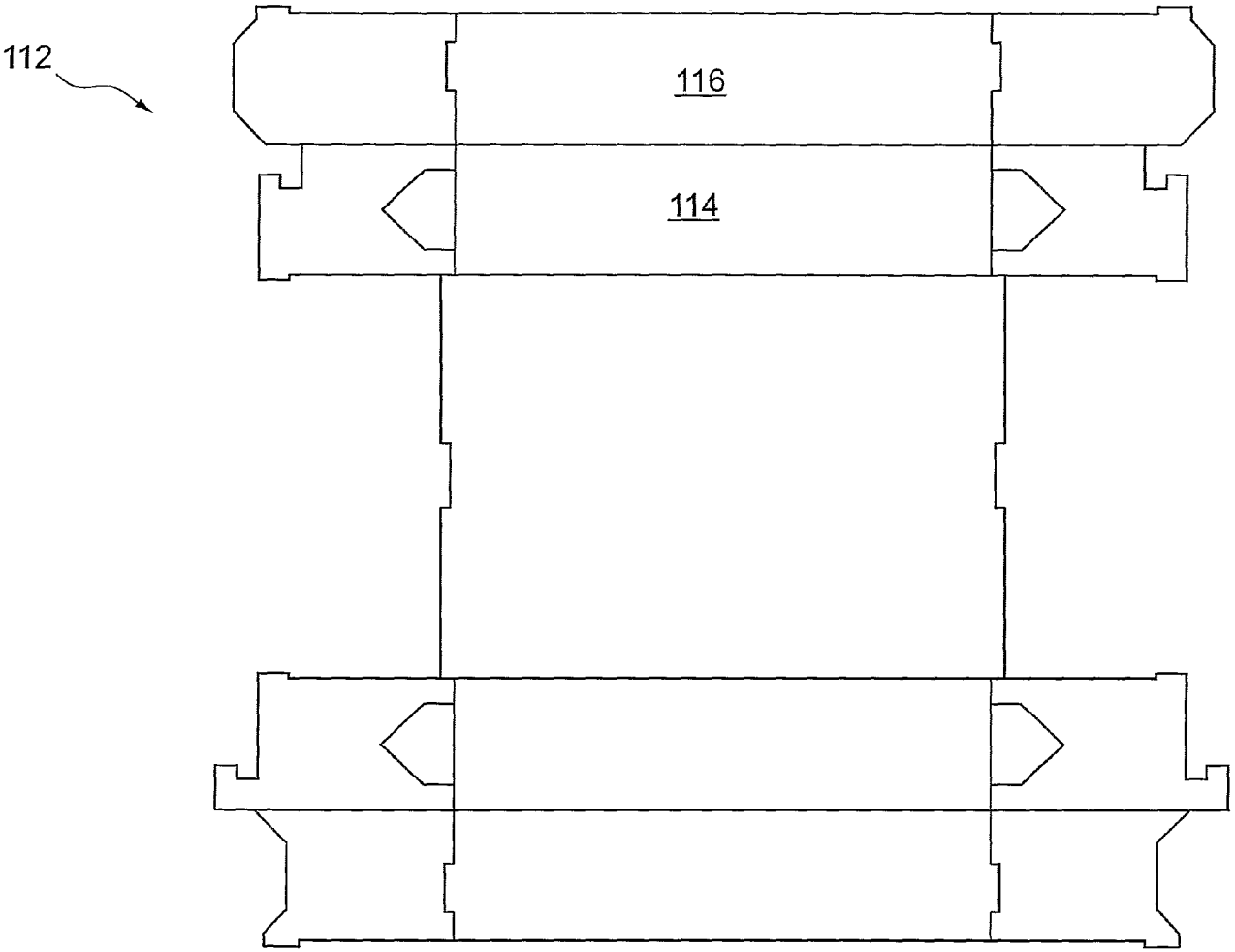
FIG. 7 is a plan view of a blank for an inner panel for use in another embodiment of the present invention.

Secondly, for a more robust box construction, the side walls formed by the inner blank can be of double thickness as illustrated by the blank 112 shown in FIG. 7 of the accompanying drawings. Here, for instance, there is a first side wall panel 114 hinged to a second side wall panel 116 by a score 118. The double thickness wall is produced by folding second side wall panel 116 against first side wall panel 114 to be in a face to face relationship therewith. It is noted that this construction does not include the corner construction shown in the FIGS. 1-6 embodiment of the present invention.

Thirdly, it will be appreciated that the outer blank 2 can be connected to the inner blank 50 in other ways. Although the tongue and slot configuration shown in FIGS. 1-4 is currently preferred, the connection could be made as simply as with an adhesive tape connecting the first side wall construction to the base panel of the inner blank.

By way of example, further embodiments of the present invention are shown in the accompanying FIGS. 8-15.

Figure 8:
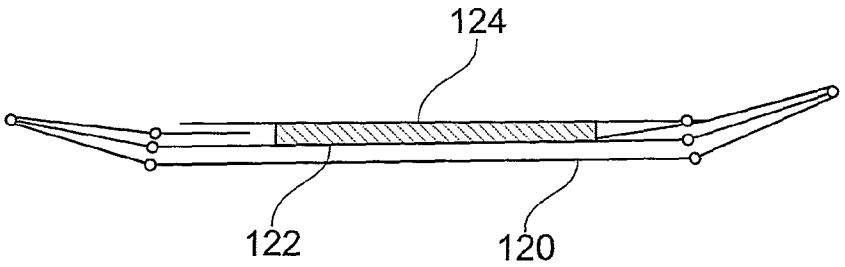
FIGS. 8 and 9 are schematic cross-sectional views of alternative box constructions in partially constructed states.

In FIG. 8 there is an outer 120, an inner 122 and an inner card 124. The inner card 124 is a simple rectangular piece of board configured to fit into the made-up box. The inner card 124 is attached (e.g. by an adhesive or tape), as shown by the hatching in FIG. 8, to the inner 122 but with unattached ends so that flanges 126 of the outer 120 can be inserted between the inner card 124 and the inner layer 122.

Figure 9:
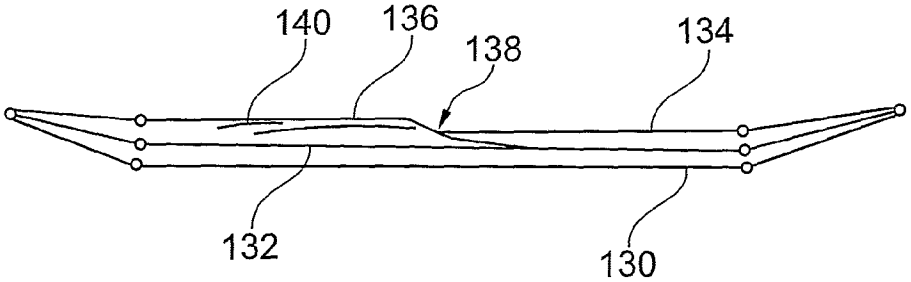

In FIG. 9 there is an outer 130 and an inner 132. Outer 130 includes extended flanges 134, 136, one of which includes a slot 138 for receiving the other flange. The end of flange 134 that underlies flange 136 is attached by a piece of tape 140 to the inner 132.

Figure 10:
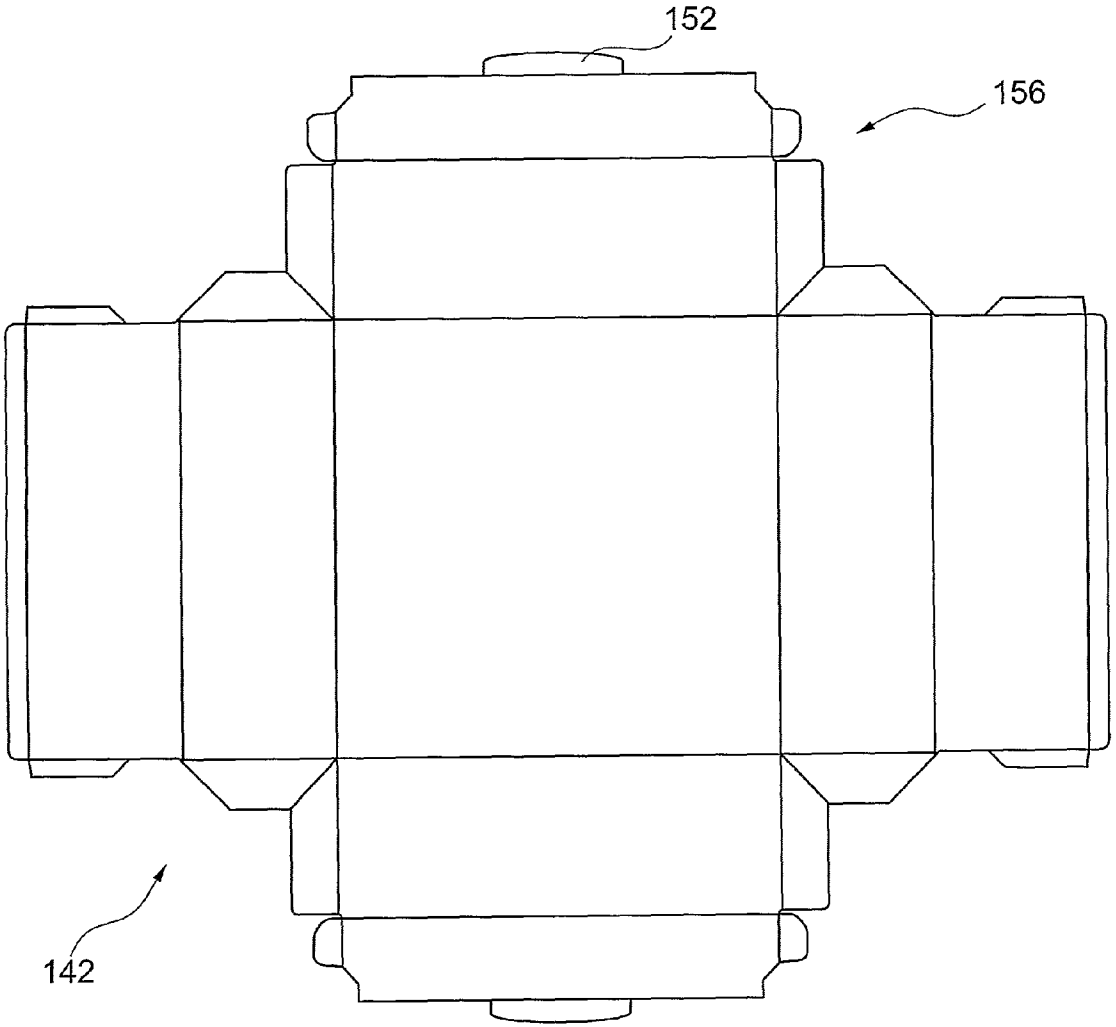
FIGS. 10-15 are plan views of blanks for use in alternative embodiments of the present invention.
Figure 11:
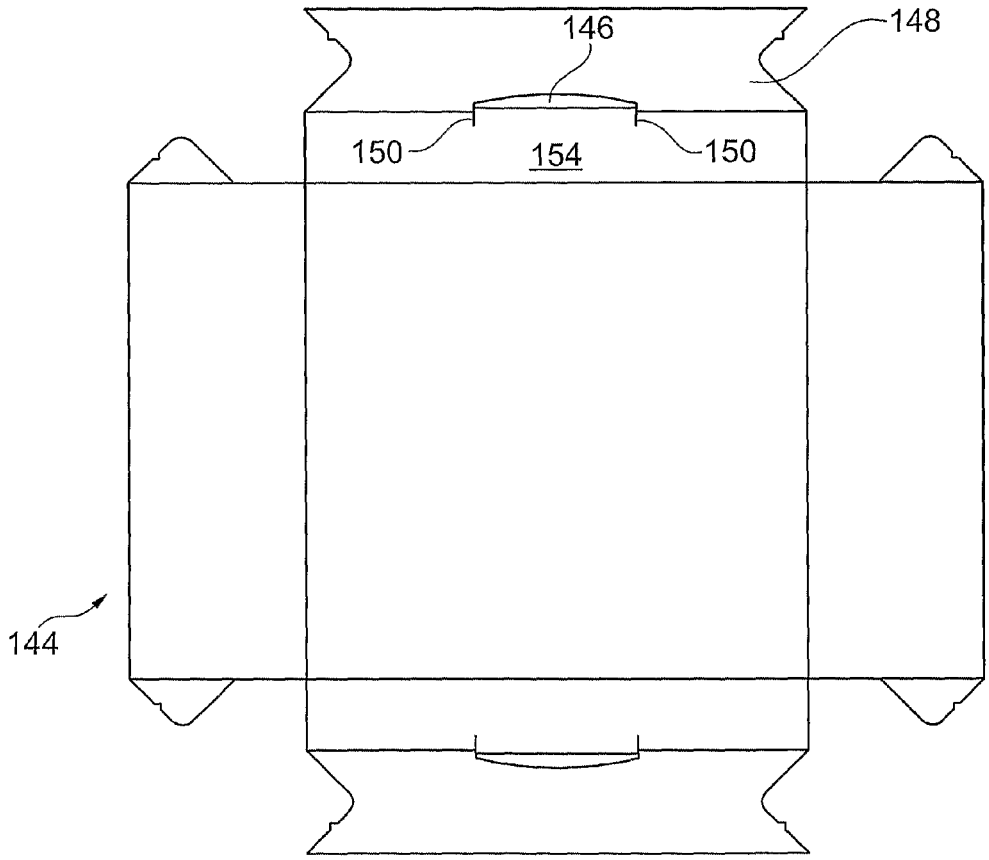

In FIG. 10 there is shown a blank being an outer layer 142 and in FIG. 111 there is shown a corresponding blank being an inner layer 144. The main difference between this embodiment and that shown in FIGS. 1 and 2 is that a slot 146 is provided in a side wall 148. Slits 150 are provided to assist in allowing a tab 152 an outer layer 142 (see FIG. 10) to slide underneath a first side wall panel 154 (FIG. 11). As compared with FIG. 1, side wall construction 156 in FIG. 10 is shorter than side wall construction 6.

Figure 12:
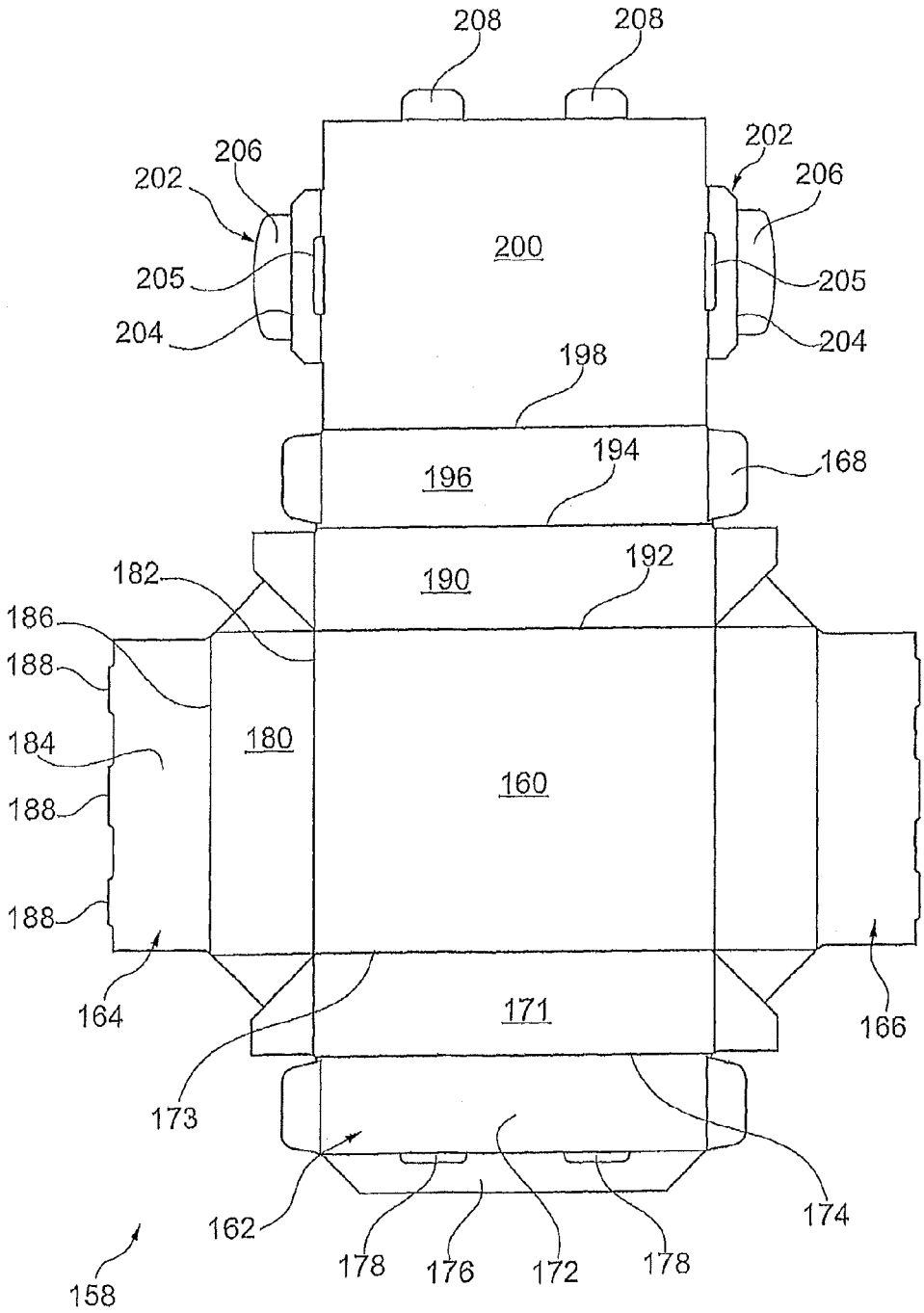

FIG. 12 shows a blank being an outer layer 158 comprising a base panel 160, a first side wall construction 162, a second side wall construction 164, a third side wall construction 166 and a fourth side wall construction 168 combined with a connected cover card 170. First side wall construction 162 comprises a first side wall panel 171 connected by a crease 173 to base panel 160, a second side wall panel 172 connected by a wide crease to first panel 171 and a tab 176 connected by a crease to second side wall panel 172. Two slots 178 are provided between the second side wall panel 172 and tab 176.

Second side wall construction 164 comprises a first side wall panel 180 connected to base panel 160 by a crease line 182, and a second side wall panel 184 connected to first side wall panel 180 by a wide crease 186. At the distal end of second side wall panel 184 are provided three tabs 188. Third side wall construction 166 is the same as second side wall construction 164.

Fourth side wall construction 168 comprises a first side wall panel 190 connected by a crease 192 to base panel 160 and a wide crease 194 to a second side wall panel 196 which in turn is connected by a cut/crease 198 to a cover card panel 200. The cover card panel 200 is rectangular, corresponding in size and shape to base panel 160 so that it can fit on top of the base panel 160. From each of the edges of cover card panel 200 adjacent the edge connecting it to fourth side wall construction 168 a tab 202 extends, which tab 202 includes a crease line 204 to provide a distal tongue 206 from the edge of cover card panel 200. Tab 202 includes a slot 205. Opposite the edge connecting cover card panel 200 to the fourth side wall construction 168 extend two tabs 208 hingedly connected to cover card panel 200.

Figure 13:
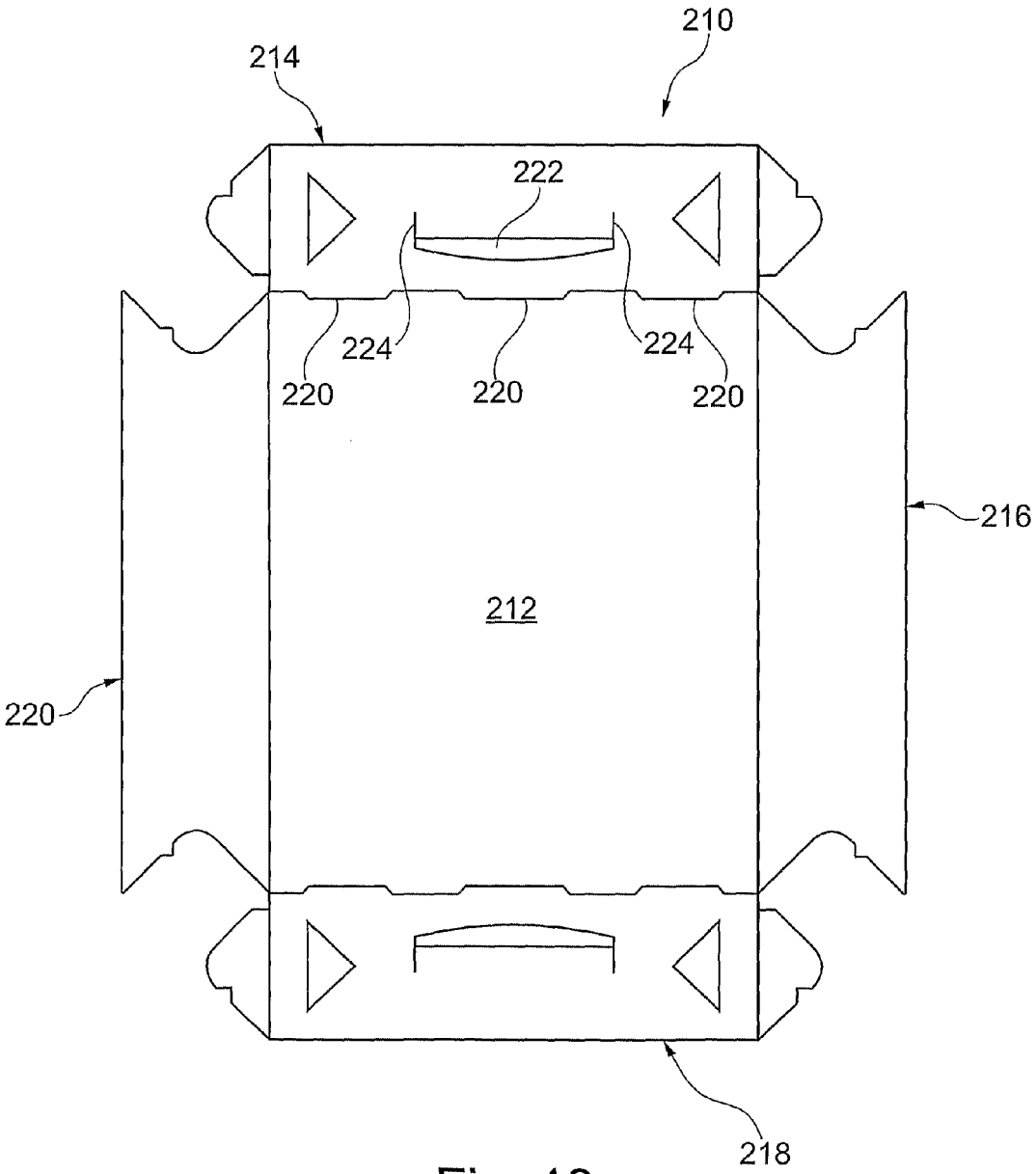

Referring to FIG. 13, there is shown a blank for an inner layer 210 for use with the outer layer shown in FIG. 12. The inner layer 210 comprises a rectangular base panel 212 from each edge of which extends a side wall panels first 214, second 216, third 218 and fourth 220, respectively. First 214 and third 218 side walls are similar, as are second 216 and fourth side walls 218. First wall panel 214 is hingedly connected to base panel 212 by score lines 220. Between the score lines 220 are cuts (through the full depth of the card). First wall panel 214 also comprises a slot 222 and side slits 224.

The manner of construction of the box from the layers shown in FIGS. 12 and 13 is similar to that described above, except that in the partly constructed "flat" configuration, the means for securing the layers relative to each other is by virtue of tabs 202 of the outer layer being located in slots 222 of the inner layer. Tabs 208 of the outer layer are also located in slots 178 of the outer layer.

Figure 14:
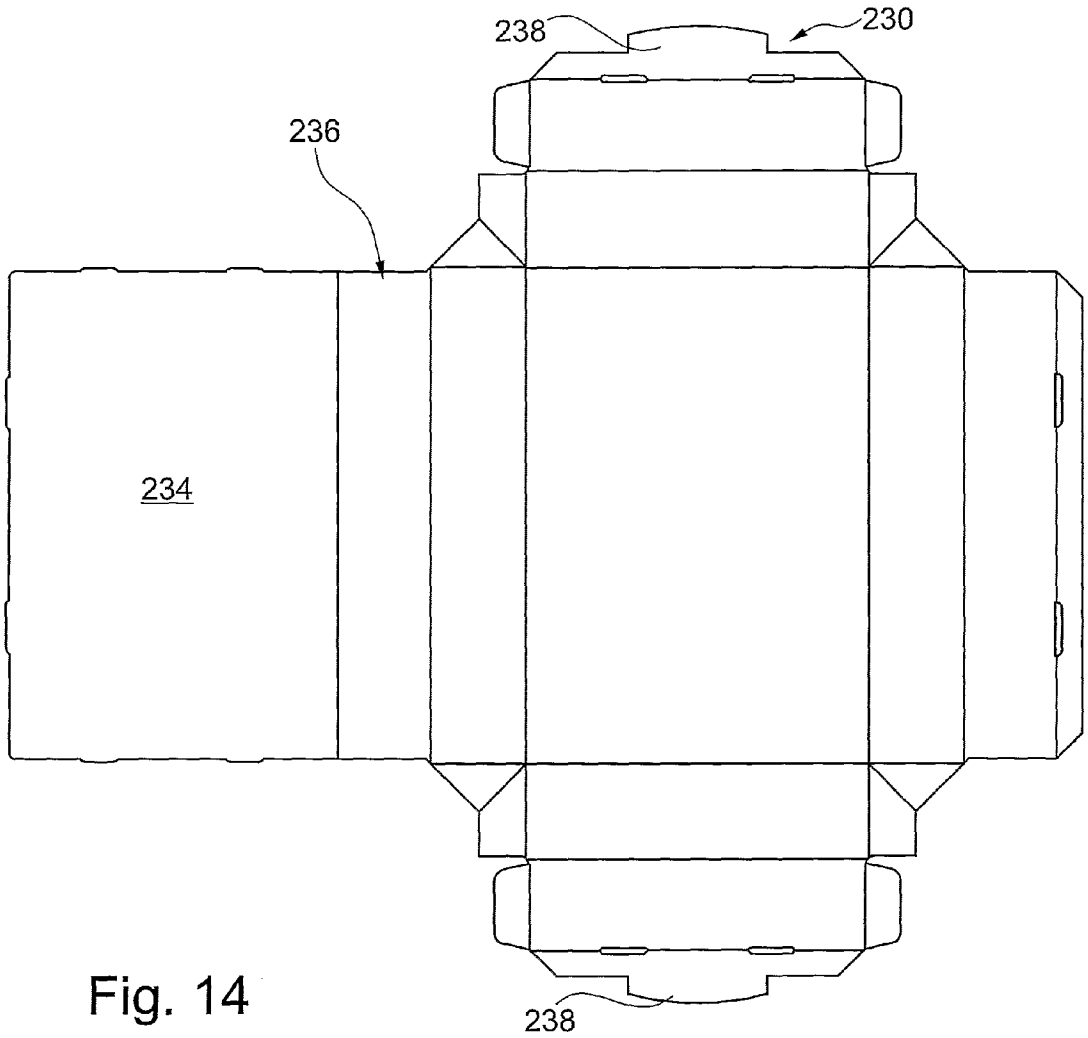
Figure 15:
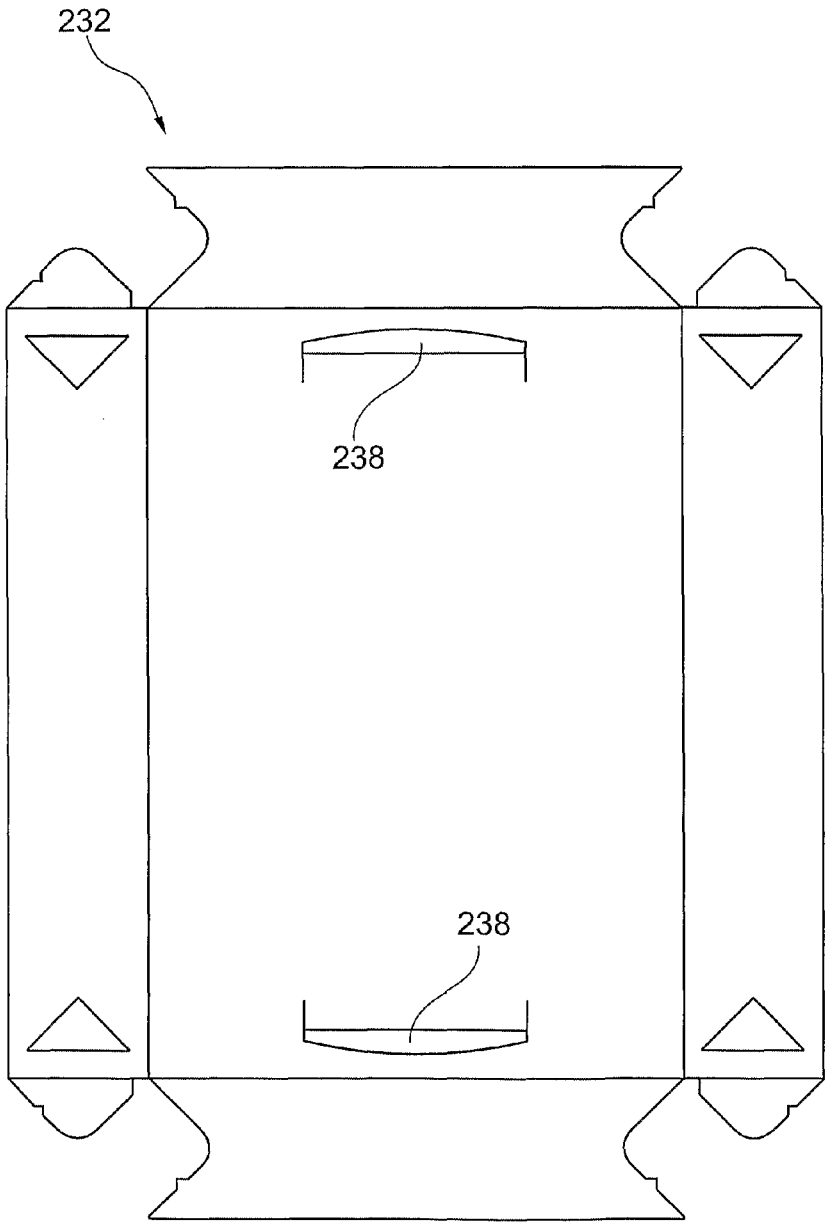

FIG. 14 shows a blank for an outer layer 230 of a further embodiment of the present invention, while FIG. 15 shows a blank for an inner layer 232 for use with the outer layer 230 of FIG. 14.

The outer layer 230 includes a cover card panel 234 hingedly connected to a side wall construction 236 and tabs 238 on adjacent side wall constructions to fit into slots 238 in a base panel 240 of the inner layer 232.

Fourthly, it will be appreciated that the cut out portions 70*a*, 70*b* and corresponding extension pieces 80*a*, 80*b* need not be triangular. Similarly, the notches 72*a*, 72*b* and corresponding cut outs 82*a*, 82*b* need not be triangular.

Fifthly, while described as a box, the embodiments of the present invention can be used as a lid (which is included within the scope of the word "box").

Sixthly, although shown as a rectangular box, other shapes and sizes can be used within the scope of the present invention.

Seventhly, it is possible for the inner and the outer to be transported separately and be brought together at the site at which the box will be made up. In this example, the ability to secure the inner to the outer by the securement means makes the manufacturing process easier as the two parts are effectively held in the correct configuration for being made up.

Thus preferred embodiments of the present invention provide a strong cornered, superior set up box which is knock down in nature. Effectively, there is provided a strong cornered carton which is also more rigid than a fold flat carton.

Attention is directed to all papers and documents which are filed concurrently with or previous to this specification in connection with this application and which are open to public inspection with this specification, and the contents of all such papers and documents are incorporated herein by reference.

All of the features disclosed in this specification (including any accompanying claims, abstract and drawings), and/or all of the steps of any method or process so disclosed, may be combined in any combination, except combinations where at least some of such features and/or steps are mutually exclusive.

Each feature disclosed in this specification (including any accompanying claims, abstract and drawings) may be replaced by alternative features serving the same, equivalent or similar purpose, unless expressly stated otherwise. Thus, unless expressly stated otherwise, each feature disclosed is one example only of a generic series of equivalent or similar features.

The invention is not restricted to the details of the foregoing embodiment(s). The invention extends to any novel one, or any novel combination, of the features disclosed in this specification (including any accompanying claims, abstract and drawings), or to any novel one, or any novel combination, of the steps of any method or process so disclosed.

The invention claimed is:

1. A partly constructed set up box in a generally flat configuration, the partly constructed set up box comprising an inner blank and an outer blank, wherein the inner blank and the outer blank are secured relative to each other by a securement means, and wherein the outer blank comprises two side wall constructions each including a tongue adapted to engage in a corresponding slot in the inner blank.

2. The partly constructed set up box of claim 1, wherein the securement means comprises an adhesive tape.

3. The partly constructed set up box of claim 1, wherein the securement means comprises a tongue and slot arrangement.

4. The partly constructed set up box of claim 1, wherein the tongue is on the outer blank and the slot is in the inner blank.

5. The partly constructed set up box of claim 1, wherein the outer blank comprises a first side wall panel connected to a second side wall panel from which the securement means secures the outer blank to the inner blank.

6. The partly constructed set up box of claim 1, wherein the inner blank comprises a base panel in which the slot is located.

7. The partly constructed set up box of claim 1, wherein the inner blank comprises a side wall in which the slot is located.

8. The partly constructed set up box of claim 1, wherein the inner blank comprises a side wall panel configured to be sandwiched between a first side wall panel of the outer blank and a second side wall panel of the outer blank.

9. The partly constructed set up box of claim 1, wherein the outer blank comprises a first side wall construction and the securement means is configured whereby the first side wall construction can be assembled.

* * * * *